US008410949B2

(12) United States Patent
Liao

(10) Patent No.: US 8,410,949 B2
(45) Date of Patent: Apr. 2, 2013

(54) EMERGENCY EXIT INDICATING DEVICE AND FIREFIGHTING SYSTEM HAVING SAME

(75) Inventor: Ming-Yang Liao, Taipei Hsein (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 850 days.

(21) Appl. No.: 12/541,691

(22) Filed: Aug. 14, 2009

(65) Prior Publication Data

US 2010/0243284 A1 Sep. 30, 2010

(30) Foreign Application Priority Data

Mar. 25, 2009 (CN) ..... 2009 1 0301139

(51) Int. Cl.
*G08B 17/10* (2006.01)

(52) U.S. Cl. ..... 340/628; 340/691.6; 340/693.5; 340/815.45; 40/570

(58) Field of Classification Search ..... 340/628–632, 340/577, 584, 506, 539.1, 539.26, 691.6, 340/693.5, 331, 332, 815.45; 40/541, 570, 40/584; 169/61, 91; 137/560; 454/342, 454/343, 345, 357, 901
See application file for complete search history.

(56) References Cited

U.S. PATENT DOCUMENTS

| | | | | |
|---|---|---|---|---|
| 3,817,161 | A * | 6/1974 | Koplon | 454/342 |
| 4,054,084 | A * | 10/1977 | Palmer | 454/342 |
| 4,763,115 | A * | 8/1988 | Cota | 340/628 |
| 4,796,018 | A * | 1/1989 | Nakanishi et al. | 340/691.1 |
| 5,446,440 | A * | 8/1995 | Gleason et al. | 340/331 |
| 6,975,237 | B2 * | 12/2005 | Barton et al. | 340/628 |
| 2004/0124989 | A1 * | 7/2004 | Bachinski et al. | 340/632 |

FOREIGN PATENT DOCUMENTS

| | | |
|---|---|---|
| CN | 2676958 | 2/2005 |
| CN | 201048022 | 4/2008 |
| CN | 201067707 | 6/2008 |

* cited by examiner

*Primary Examiner* — Anh V La

(74) *Attorney, Agent, or Firm* — Altis Law Group, Inc.

(57) ABSTRACT

An emergency exit indicating device includes an exit sign and a smoke dispelling system. The exit sign is configured for displaying where an emergency exit is located. The smoke dispelling system is configured for dispelling smoke from around the exit sign in the event of fire.

20 Claims, 3 Drawing Sheets

EMERGENCY EXIT INDICATING DEVICE AND FIREFIGHTING SYSTEM HAVING SAME

BACKGROUND

1. Technical Field

The present disclosure relates to firefighting equipment and, particularly, to an emergency exit indicating device and a firefighting system having the emergency exit indicating device.

2. Description of Related Art

Emergency exit signs are widely used in modern buildings for guiding purposes. Since visibility may be reduced in a fire due to smoke and/or failure of electric lighting, current emergency exit signs are typically capable of self-lighting, and thereby provide more reliable visibility. However, such self-lighting may still not be adequate enough to provide sufficient visibility in high density smoke conditions.

Therefore, it is desirable to provide an emergency exit indicating device, and a firefighting system having the device, which can overcome the above-mentioned problems.

DETAILED DESCRIPTION

Figure 1:
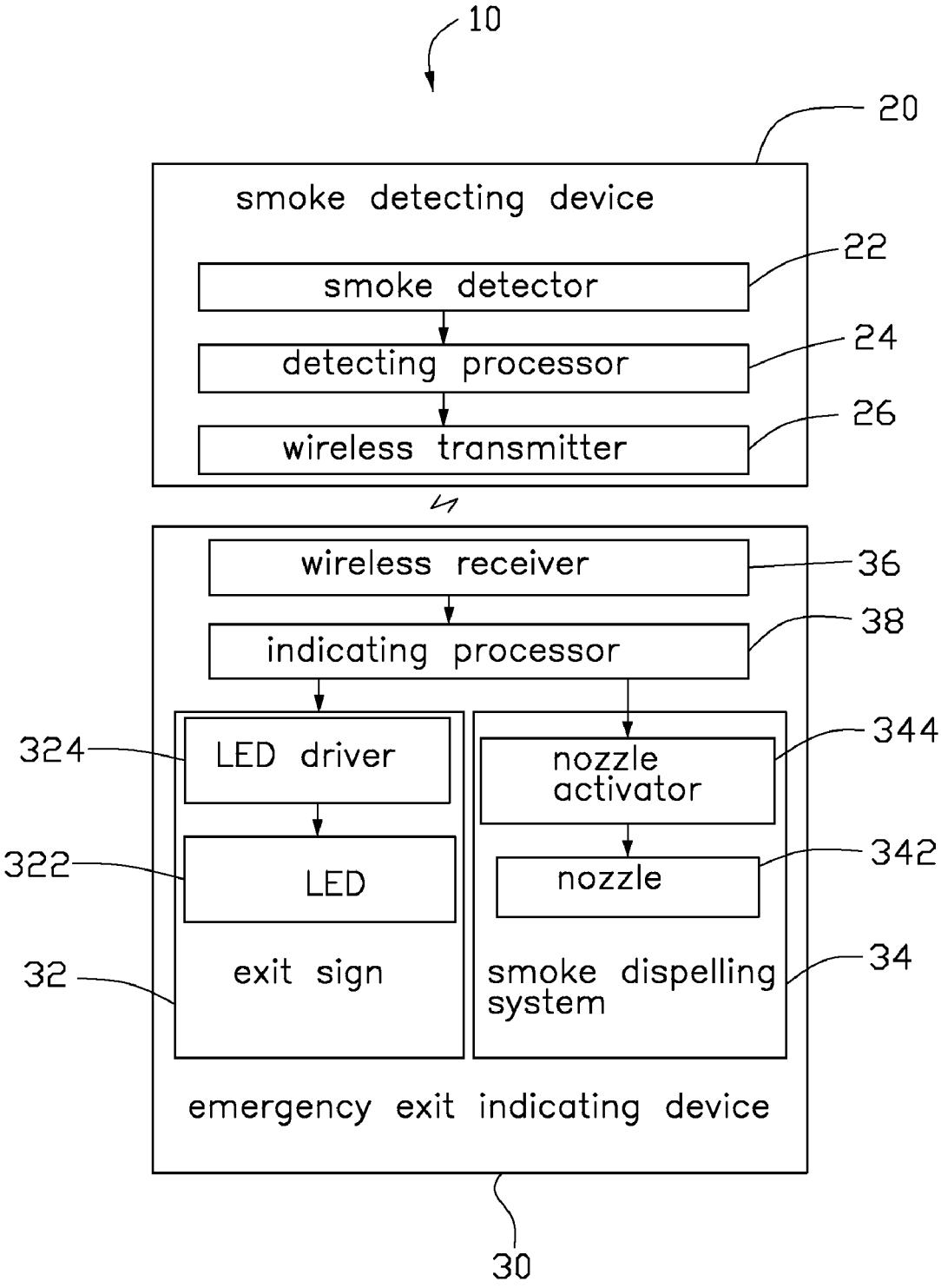
FIG. 1 is a block diagram of a firefighting system, according to an exemplary embodiment of the present disclosure.
Figure 2:
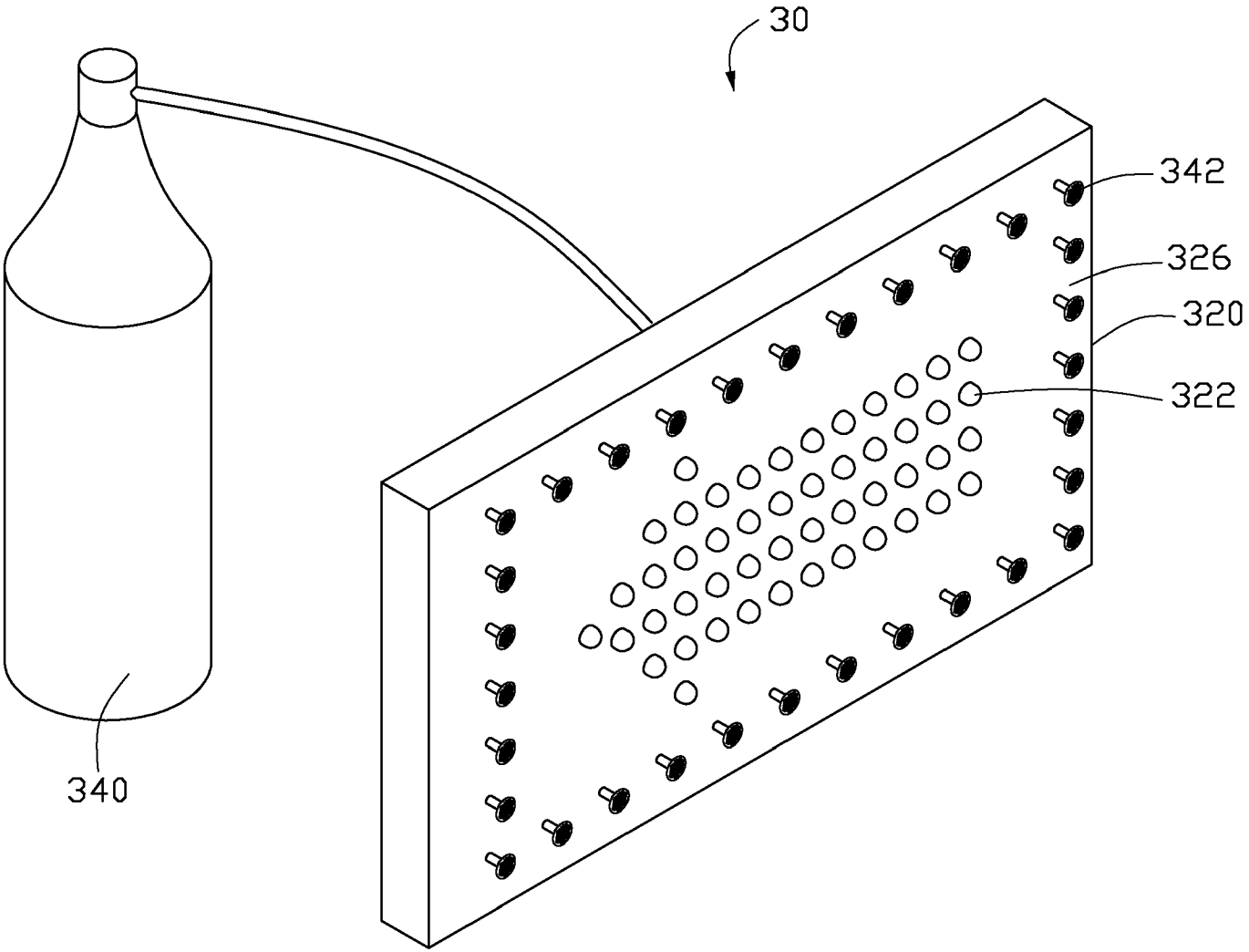
FIG. 2 is a schematic, isometric view of an emergency exit indicating device of the firefighting system of FIG. 1.

Referring to FIGS. 1-2, a firefighting system 10, according to an exemplary embodiment of the present disclosure, includes a smoke detecting device 20 and an emergency exit indicating device 30. The smoke detecting device 20 is configured (i.e., structured and/or arranged) for detecting a smoke density of the ambient environment and thereby determining whether or not there is a fire. The emergency exit indicating device 30 includes an exit sign 32 and a smoke dispelling system 34. The exit sign 32 is configured for displaying where an emergency exit is located. The smoke dispelling system 34 is configured for dispelling smoke from around the exit sign 32 in the event of fire.

The exit sign 32 is a light emitting diode (LED) type. However, it is to be understood that the exit sign 32 is not limited to this embodiment. Other types of exit signs 32 can be employed, e.g., a radioluminescence type or a phosphorescence type. In detail, the exit sign 32 includes a shell 320, a number of LEDs 322, and an LED driver 324. The shell 320 is a hollow panel in shape, and includes an indicating surface 326. The LEDs 322 are mounted on the indicating surface 326 and arranged as an arrow to point out where the emergency exit is located. However, it should be noted that, in alternative embodiments, the LEDs 322 can be arranged as other pictogram forms (e.g., a running person) with or without text (e.g. the text "EXIT"). The LED driver 324 is configured for driving the LEDs 322 to light up. To avoid the emergency exit sign 32 being obscured by heavy smoke, based upon the property of hot smoke (from a fire) rising, the exit sign 32 should be installed at a lower position at the site of use. For example, the exit sign 32 may be installed at or near floor level, thereby improving the guiding capability of the exit sign 32 under heavy smoke conditions.

In this embodiment, the smoke dispelling system 34 includes an air source 340, a number of nozzles 342, and a nozzle activator 344. The air source 340 can be a cylinder filled with compressed air, the cylinder being configured for providing high pressure air to the nozzles 342. In the present embodiment, the nozzles 342 are embedded in the shell 320, with orifice portions of the nozzles 342 protruding out from the indicating surface 326 of the shell 320. Each nozzle 342 is configured for directing airflow from an inside of the shell 320 to the outside of the shell 320. For example, the nozzles 342 may be arranged in line along four edge portions of the indicating surface 326. However, the arrangement of the nozzles 342 is not limited to this embodiment, but can be in other forms which are capable of efficiently dispelling smoke from around the exit sign 32. The nozzle activator 344 is configured for activating the nozzles 342, in the event of fire. As such, once activated, the nozzles 342 eject the high pressure air from the air source 340 to dispel any smoke from around the exit sign 32 and to effectively expose the exit sign 32.

The smoke detecting device 20 includes a smoke detector 22, a detecting processor 24, and a wireless transmitter 26. The smoke detector 22 is configured to detect and measure the smoke density of the ambient environment. Based upon the property of hot smoke rising, the smoke detector 22 is beneficially installed at a higher position at the site of use. For example, the smoke detector 22 can be mounted on a ceiling. The detecting processor 24 is configured to determine whether a fire exists at the site detected by the smoke detector 22, based upon the detected smoke density. In detail, the detecting processor 24 stores a predetermined (i.e. reference) threshold smoke density, e.g., 10%, and compares the smoke density at the detected site with the predetermined smoke density. If the smoke density at the detected site is equal to or greater than the predetermined smoke density, it is determined that a fire has broken out at the detected site. It should be mentioned that, to monitor the detected site, the smoke detector 22 and the detecting processor 24 are at all times activated. In the event of fire, the wireless transmitter 26 can wirelessly send out a firefighting signal, based upon the determination of the detecting processor 24.

In addition to the exit sign 32 and the smoke dispelling system 34, the emergency exit indicating device 30 further includes a wireless receiver 36 and an indicating processor 38. The wireless receiver 36 is configured for receiving the firefighting signal from the wireless transmitter 26, and transmitting a corresponding signal to the indicating processor 38. The indicating processor 38 is configured for, upon receipt of the corresponding signal, signaling the LED driver 324 to drive the LEDs 322 to illuminate and signaling the nozzle activator 344 to activate the nozzles 342.

Communication between the smoke detecting device 20 and the emergency exit indicating device 30 is not limited to this embodiment involving the wireless transmitter 26 and the wireless receiver 36. In alternative embodiments, for example, the smoke detecting device 20 and the emergency exit indicating device 30 can be wired and communicate via wires.

Figure 3:
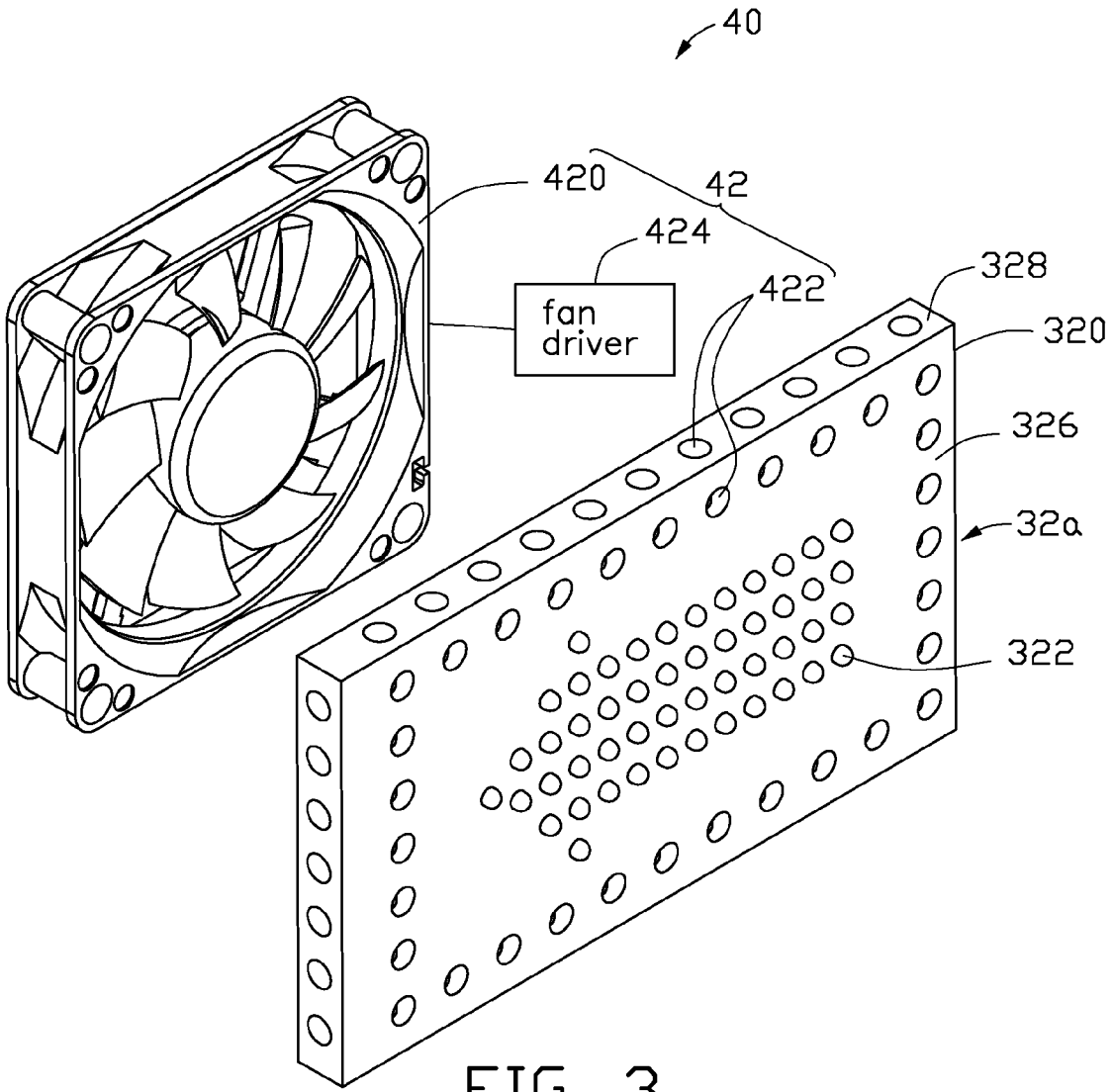
FIG. 3 is a schematic, isometric view of an emergency exit indicating device, according to another exemplary embodiment of the present disclosure.

Referring to FIG. 3, an emergency exit indicating device 40, according to another exemplary embodiment of the present disclosure, is shown. The emergency exit indicating device 40 includes an exit sign 32*a* which is essentially similar to the exit sign 32, and a smoke dispelling system 42 which is quite different from the smoke dispelling system 34. In particular, the smoke dispelling system 42 includes a fan 420, a number of vents 422 defined in the shell 320, and a fan driver 424. The fan 420 can be installed in a rear portion of the shell 320, or immediately behind the shell 320, or partly in the rear portion of the shell 320 and partly behind the shell 320. The shell 320 also includes four peripheral side surfaces 328 each connecting with the indicating surface 326. The vents 422 are defined in both the four side surfaces 328 and the indicating surface 326. In the illustrated embodiment, the vents 422 of the indicating surface 326 are arranged in line along four edge portions of the indicating surface 326 and arranged in line along the side surfaces 328. The fan driver 424 is configured for driving the fan 420. In this embodiment, once a fire is detected, the fan 420, driven by the fan driver 424, can establish airflow that travels through the vents 422 and dispels smoke from around the exit sign 32*a*. Visibility of the exit sign 32*a* is thus improved.

While various exemplary and preferred embodiments have been described, it is to be understood that the invention is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. An emergency exit indicating device comprising:

an exit sign configured for displaying where an emergency exit is; and a smoke dispelling system configured for dispelling smoke from around the exit sign in the event of fire;

wherein the smoke dispelling system comprises an air source, a plurality of nozzles, and a nozzle activator, the air source being configured for providing high pressure air to the nozzles, the nozzles being embedded in the exit sign and exposed to an outside of the exit sign, the nozzle activator being configured for activating the nozzles in the event of fire.

2. The emergency exit indicating device of claim 1, wherein the exit sign is selected from the group consisting of a light emitting diode exit sign, a radioluminescence exit sign, and a phosphorescence exit sign.

3. The emergency exit indicating device of claim 1, wherein the exit sign comprises a shell, a plurality of light emitting diodes, and a driver, the shell comprising an indicating surface, the light emitting diodes being arranged on the indicating surface in a pictogram form which points out where the emergency exit is, and the driver being configured for driving the light emitting diodes to light up.

4. The emergency exit indicating device of claim 3, wherein the pictogram form is selected from the group consisting of an arrow and a running person.

5. The emergency exit indicating device of claim 3, wherein the smoke dispelling system comprises the air source, the plurality of nozzles, and the nozzle activator, the air source being configured for providing high pressure air to the nozzles, the nozzles being mounted at the indicating surface and having first portions thereof embedded in the indicating surface around the plurality of light emitting diodes, the nozzle activator being configured for activating the nozzles in the event of fire.

6. The emergency exit indicating device of claim 5, wherein the nozzles are arranged in line along edge portions of the indicating surface.

7. The emergency exit indicating device of claim 1, wherein the air source comprises a cylinder filled with compressed air.

8. The emergency exit indicating device of claim 3, wherein the smoke dispelling system comprises a fan and a fan driver, the shell defining a plurality of vents, the fan being positioned in at least one location selected from the group consisting of in the shell and behind the shell, the fan driver being configured for driving the fan to establish airflow that travels through the vents and dispels smoke from around the exit sign in the event of fire.

9. The emergency exit indicating device of claim 8, wherein the shell further comprises four side surfaces adjacent to the indicating surface, the vents being arranged in the four side surfaces and in edge portions of the indicating surface.

10. A firefighting system comprising:

a smoke detecting device configured for detecting a smoke density of the ambient environment and determining whether a fire exists based on the detected smoke density; and an emergency exit indicating device comprising:

an exit sign configured for displaying where an emergency exit is; and a smoke dispelling system configured for dispelling smoke from around the exit sign when the fire exists;

wherein the smoke dispelling system comprises an air source, a plurality of nozzles, and a nozzle activator, the air source being configured for providing high pressure air to the nozzles, the nozzles being embedded in the exit sign and exposed to an outside of the exit sign, the nozzle activator being configured for activating the nozzles in the event of fire.

11. The firefighting system of claim 10, wherein the smoke detecting device comprises a smoke detector and a detecting processor, the smoke detector being configured for measuring the smoke density of the ambient environment, and the detecting processor being configured for determining whether a fire exists based on the detected smoke density.

12. The firefighting system of claim 11, wherein the detecting processor has a predetermined smoke density stored therein, and is further configured for comparing the detected smoke density with the predetermined smoke density, and determining that a fire exists when the detected smoke density is greater than or equal to the predetermined smoke density.

13. The firefighting system of claim 10, wherein the smoke detecting device comprises a wireless transmitter, the emergency exit indicating device further comprises a wireless receiver, and the smoke detecting device is configured for signaling the emergency exit indicating device via the wireless transmitter and the wireless receiver when a fire exists.

14. The firefighting system of claim 10, wherein the exit sign comprises a shell, a plurality of light emitting diodes, and a driver, the shell comprising an indicating surface, the light emitting diodes being arranged on the indicating surface in a pictogram form which points out where the emergency exit is, and the driver being configured for driving the light emitting diodes to light up, the nozzles of the smoke dispelling system being mounted at the indicating surface and having first portions thereof embedded in the indicating surface around the plurality of light emitting diodes.

15. The firefighting system of claim 14, wherein the smoke detecting device comprises a smoke detector and a detecting processor, the smoke detector being configured for measuring the smoke density of the ambient environment, and the detecting processor being configured for determining whether a fire exists based on the detected smoke density.

16. The firefighting system of claim 15, wherein the detecting processor has a predetermined smoke density stored therein, and is further configured for comparing the detected smoke density with the predetermined smoke density, and determining that a fire exists when the detected smoke density is greater than or equal to the predetermined smoke density.

17. The firefighting system of claim 14, wherein the smoke detecting device comprises a wireless transmitter, the emergency exit indicating device further comprises a wireless receiver, and the smoke detecting device is configured for signaling the emergency exit indicating device via the wireless transmitter and the wireless receiver when a fire exists.

18. The firefighting system of claim 10, wherein the exit sign comprises a shell, a plurality of light emitting diodes, and a driver, the shell comprising an indicating surface, the light emitting diodes being arranged on the indicating surface in a pictogram form which points out where the emergency exit is, and the driver being configured for driving the light emitting diodes to light up, wherein the smoke dispelling system comprises a fan and a fan driver, the shell defining a plurality of vents, the fan being positioned in at least one location selected from the group consisting of in the shell and behind the shell, the fan driver being configured for driving the fan to establish airflow that travels through the vents and dispels smoke from around the exit sign in the event of fire.

19. An emergency exit indicating device comprising:

an exit sign configured for displaying where an emergency exit is, wherein the exit sign comprises a shell, a plurality of light emitting diodes, and a driver, the shell comprises an indicating surface, the light emitting diodes are arranged on the indicating surface in a pictogram form which points out where the emergency exit is, and the driver is configured for driving the light emitting diodes to light up; and a smoke dispelling system configured for dispelling smoke from around the exit sign in the event of fire, wherein the smoke dispelling system comprises an air source, a plurality of nozzles, and a nozzle activator, the air source is configured for providing high pressure air to the nozzles, the nozzles are mounted at the indicating surface and have first portions thereof embedded in the indicating surface around the plurality of light emitting diodes, and the nozzle activator is configured for activating the nozzles in the event of fire.

20. The emergency exit indicating device of claim 19, wherein the nozzles are arranged in line along edge portions of the indicating surface.

* * * * *